United States Patent [19]

Lemelson

[11] 4,382,687

[45] May 10, 1983

[54] ELECTRONIC DIGITAL WATCH

[76] Inventor: Jerome H. Lemelson, 85 Rector St., Metuchen, N.J. 08840

[21] Appl. No.: 863,256

[22] Filed: Dec. 22, 1977

Related U.S. Application Data

[63] Continuation of Ser. No. 643,327, Dec. 22, 1975, abandoned.

[51] Int. Cl.[3] ..... G04B 37/12

[52] U.S. Cl. ..... 368/278; 368/284; 368/82; 368/10

[58] Field of Search ..... 58/152 R, 23 R, 4 A, 58/88 R, 88 E, 88 G, 127 R; 368/10, 62, 204, 82, 83, 84, 69, 70, 239, 284

[56] References Cited

U.S. PATENT DOCUMENTS

| | | | |
|---|---|---|---|
| 2,129,480 | 9/1938 | Schlacht | 58/152 R |
| 3,538,703 | 11/1970 | Walton | 58/23 R |
| 3,866,406 | 2/1975 | Roberts | 58/4 A |

*Primary Examiner*—Ulysses Weldon

[57] ABSTRACT

A writing implement containing electrical circuitry for keeping and displaying time. The implement includes an elongated barrel portion with a writing element having a tip portion protruding from one end thereof and an electrical time keeping device defined by an elongated support in the form of a chip or circuit board disposed within the barrel portion and having a plurality of numerical display elements which extend in a row longitudinally of the barrel of the implement and are aligned behind an elongated window which extends across a longitudinally extending opening in the wall of the barrel. Structures are provided for easily retaining and removing a battery with respect to the barrel to arrange it in circuit with electrical circuitry supported by the circuit board. Structures are also provided for easily removing the elongated circuit board from the barrel and replacing it with another board or after it has been repaired.

3 Claims, 17 Drawing Figures

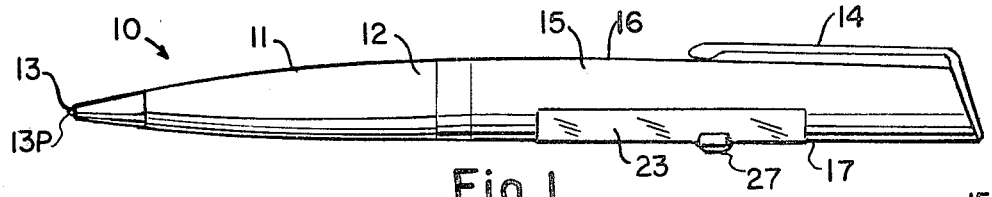
Fig. 1
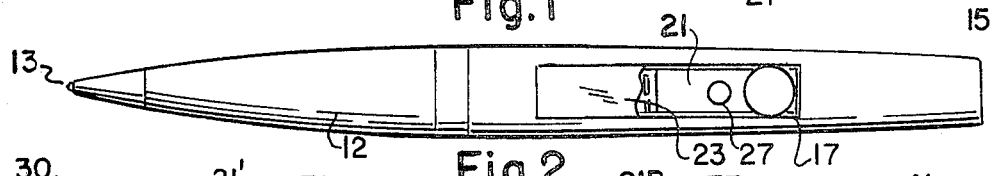
Fig. 2
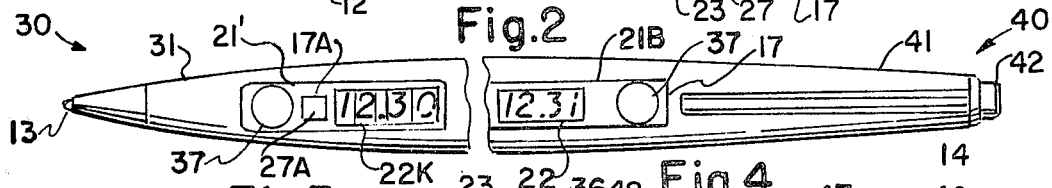
Fig. 3
Fig. 4
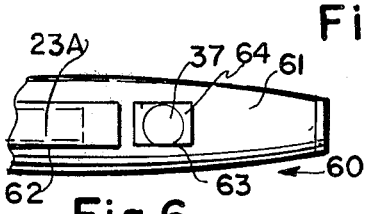
Fig. 6
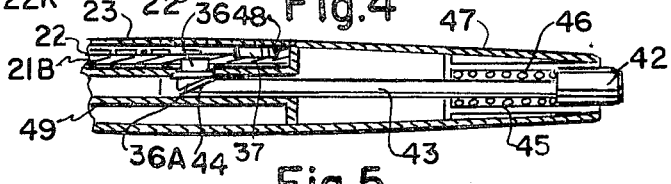
Fig. 5
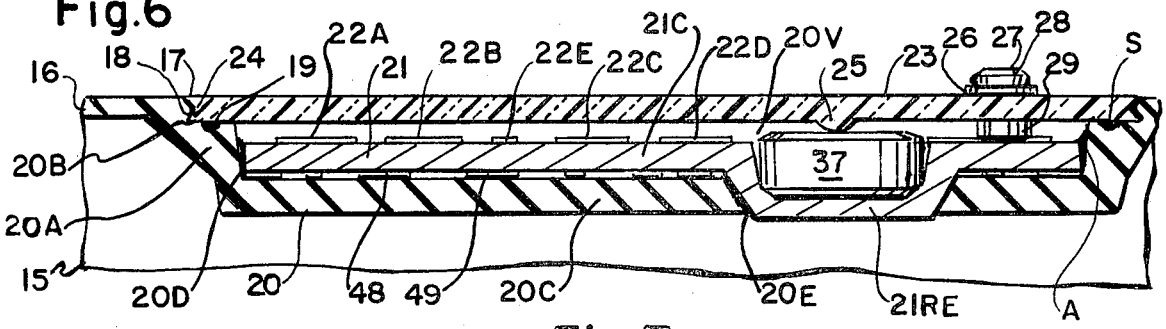
Fig. 7
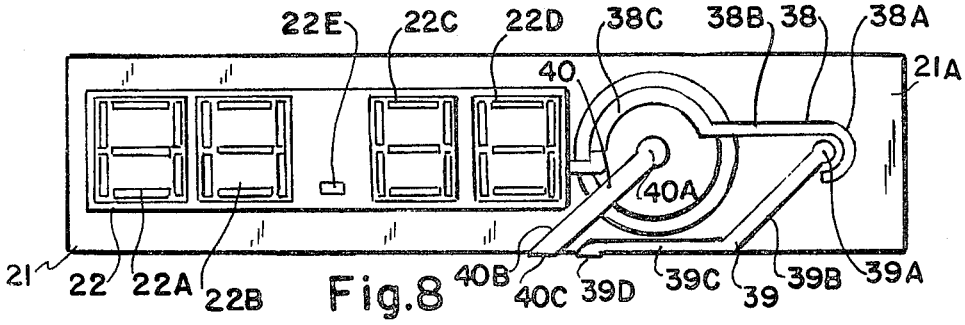
Fig. 8
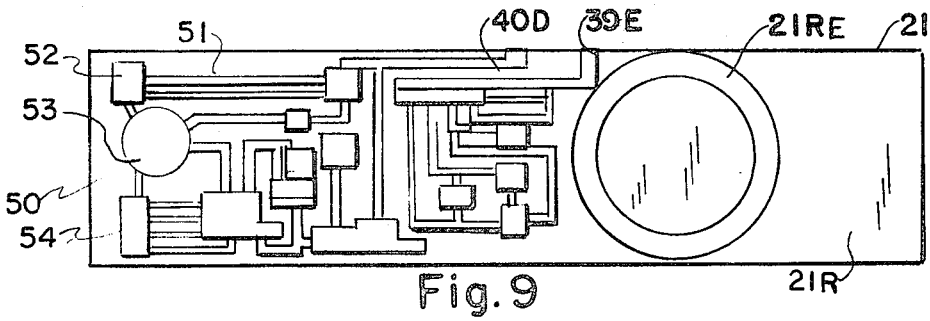
Fig. 9

ELECTRONIC DIGITAL WATCH

RELATED APPLICATIONS

This is a continuation of Ser. No. 643,327 filed Dec. 22, 1975, now abandoned, for Time Display Writing Implement.

SUMMARY OF THE INVENTION

This invention relates to improvements in pocket appliances, particularly a writing implement which is adapted to visually indicate time with substantial accuracy by electronic devices supported thereby. The display or time, such as the time of day, day of the month, year, minutes, or seconds of time, is effected by means of a time telling panel or circuit chip preferably supported behind a window which is provided along an opening or recess formed in the wall of the barrel of the writing implement and structures are provided which permit the easy assembly and disassembly of a plurality of components of the writing implement, such as a battery, the electrical circuits for operating the watch and effecting the correct display of time and, if used, one or more switches for effecting energization of the visual display elements.

So-called electronic wrist watches have become quite popular and have been developed and produced in configurations somewhat similar to the configurations of the conventional spring wound wrist watch. Microminiaturization of solid state electrical switching devices, capacitors, resistors and inductors as well as circuit interconnects has resulted in the production of circuit chips containing hundreds if not thousands of electronic components which serve to perform the calculations or functions and generate the signals necessary to either switch permanent visual display elements such as liquid crystal numerical displays or drive light emitting diode (LED) displays to visually indicate time. The configuration of the conventional wrist watch is such that the electronic components may be formed and assembled on circuit boards or chips which are circular in configuration or which easily fit within a disc-shaped container. Conventional elements employed in the construction of the conventional spring wound watch are utilized to seal the electronic components within the watch housing. An electrical push button switch, if employed for light emitting display control, is secured within an opening in the housing wall and is electrically connected to the electronic components and the battery by metal stampings and machined parts of the watch housing or die castings.

In the construction of time keeping or timing devices associated with an elongated housing, such as the barrel of a pen or pencil, the assembly and circuit connection techniques employed in the construction of conventional wrist watches and clocks are difficult and costly to employ and maintain. The main housing or pen barrel itself is generally molded in one or two sections, turned from metal tubing or stamped from metal sheet. The shape thereof is such as to preclude conventional watch assembly techniques for disposing the electronic, time display, and battery components, as well as manual switches, within the pen housing itself, without incurring high costs in assembly and in disassembly for repair and inspection purposes.

The instant invention is drawn to improvements in the construction and assembly of timing and time keeping devices supported within oblong or elongated housings, such as the tubular housing for writing implements like mechanical pencils and ball point pens, wherein the electronic time computing elements and the display are disposed in a minimum space and so assembled as to permit relatively easy access thereto together with the battery for powering these parts. Simple devices are also provided for assembling one or more pushbutton switches within the oblong implement in such a manner as to permit easy disassembly of the time keeping elements and the display without interference by the switch which is not wired or permanently connected to the electrical circuits of the time keeping and display elements. Either a simple prying or twisting action is employed to provide access to the electronic and display devices or the battery to simplify maintenance and inspection functions.

Accordingly, it is a primary object of this invention to provide improvements in the construction and assembly of time keeping devices.

Another object is to provide a new and improved writing implement which contains electronic circuitry and a display for time, such as the time of day, day of the month, time from zero, or other time or timing function.

Another object is to provide an improved time keeping device which is supported within an oblong tubular barrel and is accessible from an end of the barrel in such a manner as to easily permit the components thereof to be inspected, repaired or replaced.

Another object is to provide a time keeping and display device having electronic circuit and display means supported within an oblong recess formed in the wall of the tubular housing for a writing implement and containing all of the components of the time keeping device hermetically sealed therein in such a manner that they may be easily inspected and removed, if necessary, for repair or replacement without the necessity of using special tools or performing complex manipulations by hand.

Another object is to provide a new and improved construction in an electronic assembly applicable to watches and other appliances wherein all electronic and display components are supported on a single circuit board or chip and one or more other components, such as a battery and a switch, are easily assembled and disassembled from the board or chip for repair and replacement.

Another object is to provide a modular electronic device employing microminiature electronic circuitry and a display for the information generated by the electronic circuitry all mounted on a single flat circuit board or chip to permit the rapid and easy replacement thereof wherein the circuit board is shaped to receive and frictionally retain one or more additional components, such as a battery and a switch.

Another object is to provide an improved construction in an electronic watch assembly wherein a transparent lens cover is employed to protect and hermetically seal an enclosure for electronic and display components and the lens cover is shaped and assembled to frictionally and forcibly retain a battery in assembly with circuit interconnects for the electronic circuitry and the display.

Another object is to provide a time keeping and display device associated with a writing implement, such as a pen, supported within an oblong tubular housing wherein the portion of the housing containing the time keeping and display elements is hermetically sealed with the display elements aligned with a transparent wall of the tubular housing and a support for a battery is provided exterior of the housing portion which is sealed and wherein another portion of the housing is threadably secured to the display portion in a manner to forcibly retain the battery in electrical contact with the circuits of the time keeping and display elements.

Another object is to provide an electronic time keeping and display device in an oblong housing, such as the housing supporting a writing implement, wherein the display elements of the device are connected by a switch to the electronic circuits and a battery when the switch is closed, wherein the switch is an inertially operated switch which is closable when the oblong housing is shaken in a longitudinal direction, thereby reducing the possibility of switch closure during normal use of the writing implement.

With the above and such other objects in view as may hereafter more fully appear, the invention consists of the novel constructions, combinations and arrangements of parts as will be more fully described and illustrated in the accompanying drawings but it is to be understood that changes, variations and modifications may be resorted to which fall within the scope of the invention as claimed.

BRIEF DESCRIPTION OF THE DRAWINGS

In the drawings

FIG. 1 is a side view of a combined writing implement and watch;

FIG. 2 is a front view of the implement of FIG. 1 showing a lens cover for the watch portion partially removed to expose details of the interior assembly;

FIG. 3 is a front view of the writing implement end of a combined pen and timepiece showing details of the layout of the display, battery and pushbutton switch elements thereof;

FIG. 4 is a front view of the rear portion of a writing implement and timepiece which is activated to display time along the barrel thereof by a pushbutton switch at the rear end of the barrel of the writing implement;

FIG. 5 is a side cross sectional view of FIG. 4;

FIG. 6 is a front view of a fragment of a modified form of the structure shown in FIGS. 1 and 2 wherein separate covers are provided for the time keeping and display elements of the watch portion of the implement and the power cell or battery so that the battery may be removed without exposure of the electronic and display elements;

FIG. 7 is a side view in section of the portion of the writing implement of FIGS. 1 and 2 containing the electronic and time displaying elements;

FIG. 8 is a plan view of an electronic circuit board or chip of the type employed in the embodiments of FIGS. 1, 2 and 7;

FIG. 9 is a plan view of the rear face of the chip of FIG. 8;

DETAILED DESCRIPTION OF THE PREFERRED EMBODIMENTS

Figure 10:
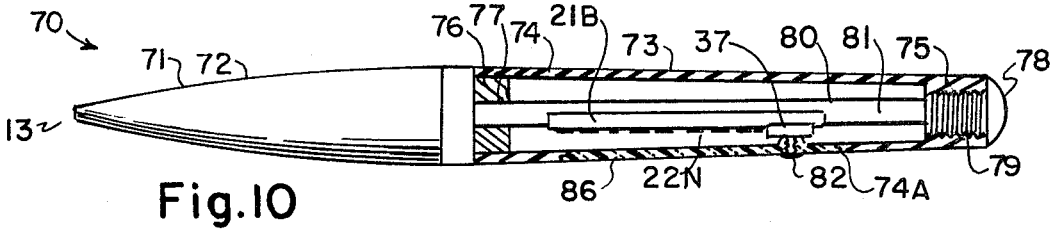
FIG. 10 is a partially sectioned side view of a writing implement showing details of another structure for supporting an electronic assembly and battery within the central portion of the tubular housing for the implement.

In FIGS. 1, 2 and 7, there is shown a writing implement 10 comprising an assembly defining an elongated tubular housing 11 formed with a lower barrel portion 12 and an upper barrel portion 15, the tubular wall 16 of which supports a pocket clip 14 at one end thereof and a transparent lens or cover 23 for a recessed portion 17 of the upper barrel. Supported within the tubular housing 11 is a writing element 13 such as a ball point cartridge, porous tip cartridge, lead holder or other form of writing element which may be projected from the tapered end of the lower barrel portion 12 and retracted therein by any conventional means, such as a mechanism responsive to turning one of the barrel portions 12 or 15 with respect to the other, or by any other known means to project and retract tip 13P thereof.

As best shown in FIG. 7, the oblong recess 17 may be formed by molding or other means in the wall 16 of the upper barrel portion 15 and contains a pan-shaped wall 20 which is an extension of the wall 16 of barrel 15 and is defined by a circumscribing side wall 20A and a bottom wall 20C, the upper portion of which defines a rectangular seat 20D for an electronic assembly 21 which will be described. The upper portion of side wall 20A is formed with a recess 20B defining a seat for a transparent plastic or glass lens 23 which serves as a cover and closure for the volume 20V defined by the recessed portion 17 of the side wall 16 and said lens or cover 23. The peripheral edge portion of the lens 23 is formed with a V-shaped recess 24 which may mate with a V-shaped protrusion 18 from the inside rim of the recess 17 permitting the lens or cover 23, when aligned with the recess 17 and firmly pressed inwardly to snap-assemble with the wall 16, to be frictionally retained against the recessed seat 20B. Element 19 is a circumscribing channel in the seat portion 20B in which channel 19 an O-ring seal S made of rubber or elastomeric plastic is compressed when the cover 23 is seated, thereby providing a hermetic seal between the cover 23 and the portions of the wall 16 of upper barrel 15 it engages so as to prevent moisture from entering the volume 20V.

Assembly 21 is composed of an oblong, rectangular parallelepiped shaped circuit board or chip 21C which preferably contains electronic circuitry necessary to keep time and visual display means for displaying the time. Assembly 21 is shaped, as illustrated in FIG. 7, for removably receiving and retaining in electrical connection with circuit elements bonded to or formed of the chip 21C, such electrical components as a battery 37, a crystal oscillator 53 shown in FIG. 9, a push button mono-stable normally open switch 27 shown in FIGS. 2 and 7, and any other elements which are necessary to permit the proper function of the time keeping mechanism. The chip or circuit board 21C is preferably a rigid rectangular parallelepiped member ⅛" to ½" wide, 1/32" to ⅛" thick and ½" to 2" long. Secured to the upper or outer face 21A shown in FIG. 8 of the chip 21C are at least five display elements denoted 22A–22E. Elements 22A–22D are numerical display elements capable of displaying the numbers 1–9 including zero and element 22E is a decimal point display element. The elements 22A–22E may be part of an assembly 22 of electrically energized liquid crystal or light emitting diode (LED) numerical displays for displaying the proper time. If the elements are liquid crystal displays, and CMOS (complementary metal oxide semiconductor) electronic time keeping and driving means are employed to drive the liquid crystal elements thereof, there is no need for an energizing switch to tell time although one or more of such switches may be employed to permit the display to perform other functions such as timing, date telling, etc. In FIGS. 1, 2, 5 and 7, monostable switches are provided to connect the LED driving circuits 51, 52, 53, 54, provided on the rear face 21R shown in FIG. 9 of the chip 21C, with a battery 37 and the displays 22. In FIGS. 1 and 2, switch 27 is a push button switch which is adhesively bonded to the wall of an opening 26 shown in FIG. 7 in the lens or cover 23. A protruding portion or tit 25 is formed in the underside of lens 23 and is located so as to bear against the upper surface of the battery 37 when the lens is frictionally retained against a recessed seat portion 21RE so as to compress said battery 37 against the bottom surface of the recessed seat portion 21RE of the circuit board 21C to force-connect the terminals of the battery 37 to respective flat strip electrical circuit elements 38 and 39 secured to the chip within the recess as illustrated in FIG. 8. These circuit elements 38 and 39 contain respective concentric end portions 38A and 39A which are engaged to the terminals at the end of the barrel 29 of push button switch 27 to connect the switch with the desired circuits of the electronic assembly 21. Lead portion 38B extends from 38A to an arcuate portion 38C formed against the bottom of the recess 21RE while a second lead portion 40B extends from the end portion 40A of circuit element 40. Elements 38C and 40A are so located that the terminals of battery 37 are engaged when it is so seated, thereby connecting the battery 37 to elements 38 and 40 and the switch 27 to elements 38 and 39. Extension 39B of element 39 is connected by an extension 39C thereof to an edge extending portion 39D while the metal interconnect 40B extends over the edge of assembly 21 by means of an extension 40C of lead 40B. The edge extending portions 39D and 40C of elements 39 and 40 then continue as strip elements 39E and 40D formed on the opposite face 21R of the chip or substrate 21C as shown in FIG. 9. Various electronic components denoted 51, 52, 53, 54, are either formed on or attached to the face 21R and are interconnected by metal strip elements 51 to form electronic circuitry 50 which serves as oscillating signal generating means for performing time keeping and display driving functions in accordance with conventional electronic time keeping circuitry.

Secured to the upper or outer face 21A of the chip 21C is the thin LED assembly panel 22 containing the numerical and decimal displays 22A–22E which are electrically connected through metallized or otherwise formed thin strip interconnects disposed beneath assembly panel 22 and connected to the circuitry 50 on the opposite face 21R of the chip 21C either by interconnections which extend over one or more of the edges of the chip 21C or through holes (not shown but disposed beneath assembly panel 22) extending completely through the chip 21C.

In a simple LED display operation, when the push button 28 of switch 27 is depressed, contacts located within the barrel 29 of the switch 27 are closed, thereby electrically connecting those circuit elements which engage the terminals of the switch 27 at the end of barrel 29 that effects electrical connection of the battery 37 or certain leads thereof to the electronic driving circuitry for the display elements on chip 21C or assembly substrate 22. The battery 37 is, when properly seated and forced into the recess portion 21RE, at all times connected to the time computing circuitry located on the opposite face 21R of the chip 21C.

A pressure sensitive, non-drying adhesive may also be disposed between the contacting portions of the lens or cover 23 and the extensions of the wall 16 against which the former is seated. Also, to effect a complete hermetic seal, a sealant or adhesive such as an epoxy resin, may be disposed between the outer surface of the recessed portion 21RE and the edge of the hole 20E shown in FIG. 7 in the bottom wall 20C when the chip 21C is properly seated and assembled within the recess 17.

FIG. 3 illustrates a modified form of the invention comprising a writing implement assembly 30 having a barrel portion 31 at the writing end thereof and containing an oblong recessed portion 17A in which is disposed an electronic assembly 21' which is somewhat similar to the assembly 21 of FIGS. 1, 2, and 7–9 but does not include a push button switch 27. The display elements provided on a strip-like substrate 22K are liquid crystal elements which constantly change with time as they are driven by signals generated by the electronic circuits on the opposite face of the circuit board when the battery 37 is connected thereto.

In FIGS. 4 and 5, there is shown another modified form of the invention wherein a display assembly 22, having separate LED numerical displays of the type described, is energized for a short period to display the proper time when a push button 42 at the far end of the upper barrel 41 is pressed into the upper barrel 41 by the thumb while the hand holds the writing implement 40. The push button 42 is connected to a shaft 43 shown in FIG. 5 and is normally urged to an outwardly protruding position by means of a spring 46 supported within a tubular retainer 45 at the end of the upper barrel 41. The other end 44 of the shaft 43 is tapered and is adapted to engage the tapered end 36A of a push button associated with a normally open switch 36 which is assembled to the circuit board or chip 21B located in the recess 48 formed in the wall 47 of the upper barrel 41. Thus, by pressing in on push button 42, the switch 36 is closed, thereby connecting suitable circuitry formed or secured to either or both surfaces of chip 21B so as to connect the driving circuits of the electronic circuitry of 21B with the display elements 22 supported thereon.

In another embodiment of the invention, an inertially operated switch, such as 27A illustrated in FIG. 3, may be connected to the electronic circuit formed on the circuit board thereof and may be operable, when the writing implement is shaken or moved in a direction which is longitudinal of or parallel to the axis of the barrel so as to connect the driving circuits with the source of electrical energy and the LED displays forming part of the display chip 22K. Such an inertially operated switch may also be employed in the other illustrated embodiments of the invention.

Other modified forms of the invention illustrated include the provisions of either a plurality of push button switches protruding from different portions of the side wall of the barrel of the pen or the end thereof, or one or more normally open inertially operated switches located in assembly with the chip for effecting one or more functions when the writing implement is properly shaken or moved. A combination push button and inertially operated switch may be used to effect respective different functions.

In yet another form, it is noted that the chip or circuit board assemblies illustrated may be modified to provide a plurality of additional numerical indicating means for indicating such additional functions as date, timing in seconds, etc. These additional numerical indicating means may be provided in line with those illustrated on a single chip or on one or more additional chips supported within the same or other recesses in the housing of the implement.

FIG. 6 shows another form of the invention whereby separate covers are provided for the display element containing portion of the electronic circuit board and the battery connected to said board so that the battery may be removed and replaced without the necessity of removing the lens cover for the numerical display portion of the board. The writing implement 60 comprises a barrel portion 61 which may be the upper or lower barrel of the implement containing two separate recesses 62 and 63 formed in alignment with each other in the side wall of the barrel. A single chip or circuit board is provided, portions of which seat within the two recesses and contain respective display elements viewable through the lens covering recess 62 and a receptacle portion for a battery 37 disposed within recess 63. A removable cover 64 is provided over the recess portion 63 and may be hingedly, threadably or otherwise removed from the recess 63 to permit the battery 37 to be removed and replaced or checked when the cover 64 is removed without the necessity of removing the lens 23A from the recess 62.

The electronic circuitry provided on the chips or circuit boards illustrated in the drawings may be made in accordance with the teachings of such U.S. Pat. Nos. as 3,672,155; Re. 26,187; 3,576,099; 3,560,998; 3,169,892 and 3,461,347. The circuit interconnecting elements 38,40,51 and others shown in FIGS. 8 and 9 may be formed by etching or depositing them onto the substrate board 21 or by anodic isolation thereof from a deposited metal film covering at least a portion of the chip or board. Connection of the electronic display elements and other circuit elements provided on the upper or outer surface 21A and the circuit elements, which are deposited or secured to rear surface 21R of the board 21, may be effected by depositing circuit connecting elements, such as 39D and 40C, over and around the edge or edges of the board or by plating or depositing conducting material through the board by providing holes therethrough in alignment with circuit interconnecting elements on both surfaces to be electrically connected.

In addition to or as a supplement for the compressible resilient sealing ring S shown in FIG. 7 for sealing the lens 23 to the pen barrel, a pressure sensitive adhesive sealant may be employed around recessed shelf 20B. Such a sealant and adhesive may also be applied to the bottom side of board 21 or the lateral edge thereof to secure it to the surface of the recessed seat 20D in a manner whereby it may be removed for replacement or servicing thereof by prying it off the upper surface of the bottom wall 20C of the pan-shaped wall 20 when the lens 23 has been removed from the barrel wall 16.

FIG. 10 shows a modified form of the invention comprising a writing implement 70 defined by a housing 71 which consists of a forward tapered portion 72 at the narrow end of which is disposed or supported a writing device 13 of the type described. Forward portion 72 is connected to a rear section 73 shown as having a tubular wall 74 of cylindrical or other suitable shape at one end of which tubular wall 74 is provided a threaded portion 75 thereof or a tubular insert with internal threads 79. A second assembly 80 extends axially through the rear tubular section 73 of the housing assembly 71 and consists of a rod-like support 81 which is connected at one end to the threaded fitting 79 and slideably engages its other end in a hole 77 extending axially through a plug 76 which is secured to the inside surface of the tubular wall 71 at or near the end thereof. Secured to the rod 81 is an electrical circuit board 21B containing a plurality of numerical display units 22N of the type described and provided in FIGS. 3, 4, 7, 8 and 9. The substrate or chip 21B is preferably of the type illustrated in FIGS. 8 and 9 and is adhesively bonded or otherwise secured to the rod portion 81 of assembly 80. The end of rod 81 extending to the threaded fitting 79 may slideably engage an axial hole therein or may be bonded thereto. If the other end of rod 81 is either frictionally secured within plug 76 or is shaped to prevent rotation of rod 81 in the hole or cavity 77 in plug 76, then removal of the fitting 79 from the threaded portion 75 of the tubular wall 74 will permit the assembly 80 to be axially removed from the end of rear housing section 73 through the opening in the threaded fitting or end portion 75 thereof.

In order to maintain a battery 37 compressed against the described electrical circuit leads extending along the surface of the chip 21B to the electronic circuit elements secured to or deposited on the rear and front faces of the chip 21B, a tiny screw or plug 82 is threadably turned in a threaded portion of a transparent lens 86 extending across an opening 74A in the tubular wall 74. When the screw 82 is tightened against the outer face of the housing for the battery 37, the screw 82 compresses the battery 37 against the interconnects extending across that portion of the surface of the circuit board 21B. These interconnects are aligned with the battery 37 and the receptacle or recess which is formed in the circuit board 21B for receiving and aligning the battery thereon. Screw 82 may comprise a set screw or decorative headed screw and is removable to release its force against the battery 37 when it is desired to remove the assembly 80 from the rear tubular barrel section 73 for inspecting or removing the chip 21B, the battery 37, or any other component thereof. Plug 76 may be threadably secured or adhesively bonded to the end of the tubular housing wall section 74. Rod 81 may also be adhesively or otherwise secured to the wall of the opening 77 in plug 76 and removed from the housing by threadably or otherwise removing the plug 76 from retention by the end of the wall 74 or an insert therein.

Figure 11:
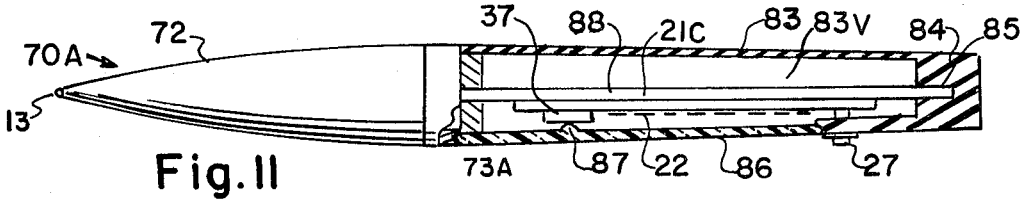
FIG. 11 is a partially cross sectioned side view of a modified form of writing implement and mount for an electronic circuit and a time display of the type shown in FIGS. 8 and 9.

In FIG. 11, there is shown a modified form of an assembly of the type shown in FIG. 10 and defining a combined writing implement and time keeping device 70A. The rear tubular housing 83 is formed with a solid rear end portion 84 having an axially extending cavity 85 therein into which cavity 85 the end portion 84 of a rigid rod 88 is slideably or frictionally inserted to retain the rod 88 and an electronic time keeping circuit board 21C centrally disposed within the confined and sealed interior volume 83V of the barrel of the writing implement 70A, such that the display elements 22 of the board 21C are aligned with a lens cover 86 so that they may be viewed from the exterior of the housing. The lens cover 86 is shaped to define it as a smooth extension of the wall of the housing 83 and is preferably adhesively bonded by means of an epoxy or other suitable resin to the opening in the housing into which it is inserted. A protruding portion 87 of the lens cover 86 extends inwardly into volume 83V and is located so as to forceably engage the outer face of a button-shaped battery 37 and force the battery 37 against interconnecting circuit elements formed on or disposed against the shaped surface of the circuit board 21C which contains all of the signal generating, time keeping, and display elements of the time keeping device defined thereby. The battery 37 is removable when the lens cover 86 is removed from its receptacle defined by peripheral portions of the opening in the housing 83 across which it extends. In FIG. 11, a normally open spring biased push-button switch 27 is secured to a portion of the wall of the tubular housing 83 and is so located as to permit its terminals to frictionally engage circuit interconnect components secured to the face of the circuit board 21C to permit said switch 27 to function properly when it is temporarily closed by pushing the push-button 26 shown in FIG. 12 and to effect the generation of signals which drive the display elements of the visual displays 22 shown in FIG. 11.

Figure 12:
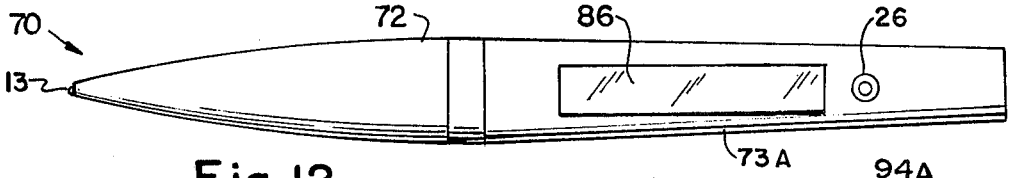
FIG. 12 is a front view of the implements of FIGS. 10 and 11.
Figure 13:
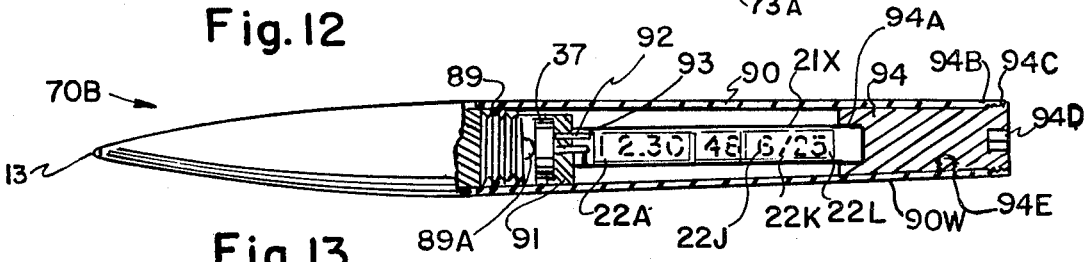
FIG. 13 is a partially sectioned side view of another type of support for a time keeping and display device associated with a writing implement wherein electronic components are hermetically sealed in a tubular barrel and a battery is supported exterior of the sealed volume and is kept in electrical assembly with the circuits of the electronic components by the components of the assembly.

In FIG. 13, there is shown a modified form of the invention wherein a battery 37 is inserted longitudinally into the end of the rear portion of the tubular barrel 90 and is retained against a plug fitting 91 which is bonded or otherwise secured to the wall 90W at its end. A pair of strip or pin-like terminals 92 extends through the plug fitting 91 and makes contact at one end of the terminals 92 of the battery 37 when the battery 37 is properly seated against the plug fitting 91 and contacts at their other ends lead elements 93 for the circuit board 21X. The far end of the circuit board 21X extends into a complementary shaped cavity 94A in a plug 94 which is threadably or adhesively secured within the end of the barrel 90. The other end of the chip or circuit board 21X is adhesively bonded to or secured within a cavity in the inside face of the plug fitting 91, thus retaining the circuit board 21X centrally disposed within the tubular housing 90 and aligned with a window 86 extending across an opening in the wall of tubular housing 90, as illustrated in FIG. 12. The plug 94 contains threads 94C at the far end 94B thereof and a shaped cavity 94D for receiving the end of a special tool such as an Allen Wrench for removing the plug from the end of the tubular barrel 90 to prevent removal of the circuit board 21X from the barrel 90. A threaded radially extending hole 94E is formed in the plug 94 and receives a set screw therein for retaining the plug 94 in proper alignment within the barrel 90 and preventing the plug 94 from falling out or being removed.

Figure 14:
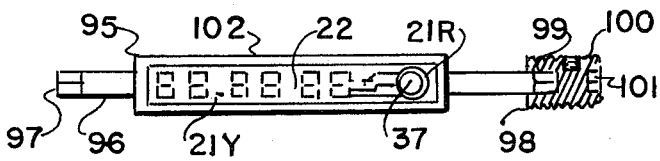
FIG. 14 is a plan view of a support for an electronic time keeping and display unit, which support may be utilized in assemblies of the types shown in FIGS. 10 and 11.

In FIG. 14, an assembly 95 is provided which is a modified form of assembly 80 of FIG. 10. A rod-shaped support 96 is provided which is either molded integral with or has attached thereto an oblong retainer 102 for a circuit board or chip 21Y which contains a plurality of electronic numerical displays 22, a battery 37 secured to a retainer 21R formed in the chip 21Y, and all the other circuit interconnects and elements necessary to perform the desired time signal generating and display driving functions. Construction of board 21Y may be similar to that shown in FIGS. 8 and 9 although it is illustrated as containing extra display elements for displaying seconds, minutes or hours or the day of the month.

The end portion 97 of the rod-shaped support 96 is shown as having rectangular formations which respectively insert into rectangularly shaped cavities in plugs or retainers secured at both ends of assembly 95 within the tubular housing of the writing element by one or more of the techniques illustrated in FIGS. 10–13. An end plug 98 is shown secured to the far end of rod 96 and contains a threaded peripheral surface 99, a radially extending threaded hole 100 for the insertion and retention of a set screw (not shown) extending through a hole in the tubular wall of the implement 70B, as illustrated in FIG. 13, and a rear cavity 101 into which an Allen Wrench or other form of wrench may be inserted for removing the plug 98 and the assembly 95 either therewith or after the plug 98 has been removed. If the rod 96 is axially secured to plug 98 and must rotate therewith, then the other end portion 97 of the rod 96 is preferably cylindrical and slideably engages within the cavity or hole through the plug at the far end of the barrel 90 which supports the rod 96 and the assembly 95 centrally disposed within the barrel 90 of the writing implement 70B.

Figure 15:
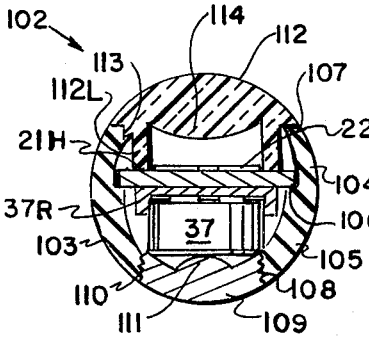
FIG. 15 is a cross sectional view taken across the barrel of a writing implement at a portion thereof containing an electronic time keeping device disposed behind an enlarging lens forming part of the barrel of the implement.

In FIG. 15, there is shown cross-sectional details of another assembly of a writing implement 102 and electronic time keeping and display elements. The implement 102 is defined by an injection molded plastic barrel portion 103 composed of a main barrel portion of tubular shape and configured along the lines of the barrels of the writing implements of FIGS. 10 to 13 with a somewhat heavier side wall 104 having one side 105 thereof containing a threaded opening 108 into which a removable plastic or metal plug 109 may be threadably assembled to permit access to the battery 37 employed to power the electronic circuits of an oblong flat circuit board or chip 21H containing display elements 22 formed or assembled along its length for displaying time as described above. The circuit board 21H contains a retainer 37R for the battery 37 assembled to its underside and containing leads or interconnecting conducting strip elements on the bottom surface thereof for connecting the battery 37 to the circuit elements of the board 21H when the battery 37 is compressed therein. A tit or dome portion 111 of the plug 109 is forced against the face of the battery 37 when the threads 110 of the plug 109 engage and are turned in the threads 110 in the wall of the opening 108 in the wall 104 of the barrel 103. The peripheral portions of the circuit board 21H rest on a shelf portion 106 molded in the side surface of the barrel side wall 104. The upper surface of circuit board 21H is engaged by the downwardly projecting rim of the sidewall or legs 112L of a cover 112 for an oblong opening 107 in the wall 104 of the barrel 103. The cover 112 is molded of transparent plastic and is shaped with the central portion 114 thereof extending the length of the display elements 22 and defining an oblong enlarging lens for the displays 22 to be read easily through the lens. The rim 113 of the cover 112 is preferably shaped to frictionally assemble or snap-assemble with the rim of the oblong opening 107 in the barrel portion 104. The cover 112 may also be fastened with one or more screw fasteners or other fasteners to the barrel portion 104 or may be welded or adhesively bonded thereto. Sealing means, as described above may also be provided between the barrel portion 104, plug 109, and cover 112.

Figure 16:
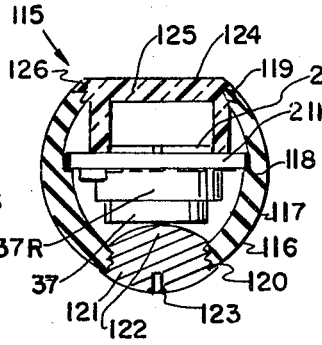
FIG. 16 is a cross sectional view taken across the barrel of a writing implement similar to that of FIG. 15 but having a flat lens for viewing the display wherein the lens and an adjustment plug cooperate in retaining the elements of the electronic device and its battery in an operating assembly.

In FIG. 16, a writing implement 115 is provided with a barrel 116 having a heavy side wall 117 containing a circular threaded opening 120 and an oblong opening 119 extending in the direction of the longitudinal axis of the wall of the barrel 116 on the side thereof which is opposite opening 120. A plug 121 with a threaded side wall contains a slotted cavity 123 for accomodating the blade of a screw driver for turning the plug 121 in tightening it into the opening 120 and removing it therefrom. The inside crown 122 of the plug 121 engages the outer face of a battery 37 held in a recepticle 37R, as described above. A shelf 118 formed on the inside of the barrel side wall 117 receives and positions the electronic chip or circuit board 21K against the protruding rim or legs of a lens 124 which is secured against the rim of the elongated opening 119 in the other side of the side wall 117 of the barrel 116. A wall 125 of the lens 124 extends across the opening 119 and is flat. Its lateral edges 126 are each shaped with dovetail portions which snap assemble with dovetail shaped portions of the rim of the opening 119.

Figure 17:
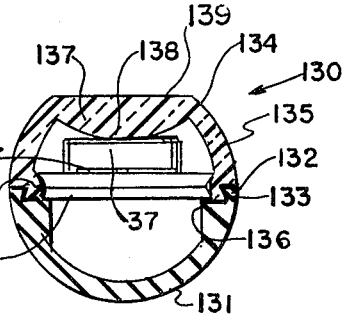
FIG. 17 is a cross sectional view taken across the barrel of a modified form of writing implement and time keeping and display device supported therein.

In FIG. 17, a writing implement 130 is made with an elongated barrel formed of an opaque plastic molded section 131 defining approximately half of the barrel which snap assembles with a transparent plastic half section 134 by means of respective properly shaped rim portions 132 and 133 thereof which are dovetail shaped as shown. Frictionally assembled across the open side, of the half section 134, an electronic circuit board 21L contains, as in FIGS. 15 and 16, all the microminiature electronic circuitry necessary to drive visual display elements 22 bonded to its surface facing the transparent half section 134. A hearing aid type miniature battery 37 of cylindrical shape is shown secured to the outer facing side of the board 21L, preferably in a recess (not shown) formed therein.

The sidewall 135 of the barrel half section 134 is shaped to define an extension of the cylindrical or arcuate side wall of the molded half section 131. Rim portion 133 of the barrel section 131 contains a shelf formed therein. On this shelf, the circuit board 21L rests or is secured by bonding. In FIG. 17, the circuit board 21L has its edge wall formed with a circumscribing recess therein which permits snap frictional assembly thereof with a beaded portion 140 of the rim of the transparent barrel half section 134. This beaded portion 140 protrudes inwardly from at least a portion of the rim thereof. The viewing portion 137 of the transparent barrel half section 134 is formed with a flat outside surface 139 and an enlarging lens portion 138 defining a convex inside surface,. A bottom part of lens portion 138 engages and compresses the battery 37 against the recessed portion of board 21L. A seal or sealant, as described above may be provided between the assembled components to hermetically seal the interior of the barrel of the writing implement 130 or a portion thereof containing the illustrated electrical components.

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. An electrically operated time indicating appliance comprising in combination with an assembly including an elongated tubular barrel defining a housing for said appliance, a first opening in the side wall of said barrel and a transparent window means extending across and sealing said first opening, a writing implement secured to said assembly and protruding from an end thereof, a second opening to said barrel providing longitudinal access to the interior of said barrel, closure means, and means for removably securing said closure means across said second opening, an elongated electrical circuit board having electrical circuit means operable for computing and generating time defining electrical signals and display means secured to a major surface of said circuit board and connected to said electrical circuit means for variably generating a visual indication of time in accordance with the signals generated by the electrical circuit means of said circuit board, said elongated electrical circuit board being narrower than said second opening to permit said circuit board to be endwise inserted into said second opening and to be moved longitudinally through said barrel, means for slidably supporting said elongated circuit board within said barrel aligned with said transparent window means to permit said display means to be viewed from the exterior of said housing through said first opening and to permit the removal of said circuit board through said second opening when said closure means is removed, and an electric battery and means for electrically connecting said battery to said electrical circuit means including means for receiving said battery and means for compressing said battery against said connecting means when said barrel, said receiving means and said circuit board are operatively assembled.

2. An appliance in accordance with claim 1 wherein said means for compressing said battery against said connecting means includes said closure means for said second opening.

3. An appliance in accordance with claim 2 wherein said closure means comprises a removable plug at one end of said tubular barrel, said removable plug supporting said elongated electrical circuit board within said tubular housing.

* * * * *